United States Patent [19]

Friedberg

[11] 4,232,430

[45] Nov. 11, 1980

[54] DEVICE FOR CONNECTING THE ENDS OF A SEPARABLE ZIPPER

[76] Inventor: Martin F. Friedberg, 7233 Aberdeen, Dallas, Tex. 75230

[21] Appl. No.: 20,318

[22] Filed: Mar. 15, 1979

Related U.S. Application Data

[63] Continuation-in-part of Ser. No. 940,255, Sep. 7, 1978, which is a continuation-in-part of Ser. No. 895,935, Apr. 13, 1978, abandoned.

[51] Int. Cl.[3] ..... A44B 19/36

[52] U.S. Cl. ..... 24/205.11 R; 24/208 A

[58] Field of Search ..... 24/205.11 R, 205.11 F, 24/208 A

[56] References Cited

U.S. PATENT DOCUMENTS

| | | | |
|---|---|---|---|
| 1,704,579 | 3/1929 | Sanford | 24/205.11 R |
| 3,004,318 | 10/1961 | Weiser | 24/205.11 R X |
| 4,139,927 | 2/1979 | Heimberger | 24/208 A X |

FOREIGN PATENT DOCUMENTS

| | | | |
|---|---|---|---|
| 117965 | 6/1930 | Austria | 24/205.11 R |
| 682960 | 6/1931 | France | 24/205.11 R |
| 363596 | 12/1931 | United Kingdom | 24/205.11 R |

*Primary Examiner*—Philip C. Kannan
*Attorney, Agent, or Firm*—Peter J. Thoma

[57] ABSTRACT

An improved device for connecting the ends of a separable zipper having opposed strings or rows of interlocking teeth or elements including specially adapted terminals which facilitate the engagement of the ends of the zipper and initial movement of a slider to fasten the zipper teeth. The terminals are engagable by being brought together in a direction substantially perpendicular to the zipper rows. Compared to the conventional pin-and-socket terminal arrangement wherein the pin must be threaded through one relatively small port of the slider and then into the socket, the terminals are relatively large and essentially self-aligning during engagement. Once engaged, the terminals are free to rotate relative to each other, thus permitting the opposed rows of zipper elements to self-align as the slider is urged forward to engage the rearmost ends of the zipper elements.

51 Claims, 17 Drawing Figures

DEVICE FOR CONNECTING THE ENDS OF A SEPARABLE ZIPPER

This is a continuation-in-part of U.S. patent application Ser. No. 940,255, filed Sept. 7, 1978, which in turn is a continuation-in-part of abandoned U.S. patent application Ser. No. 895,935, filed Apr. 13, 1978. All of the subject matter of said prior applications is hereby incorporated by reference herein to the extent such subject matter is consistent with the following description of the presently preferred embodiments of the invention.

The present invention pertains generally to slide fasteners and more particularly to the type of slide fastener commonly known as a zipper which has opposed strings or rows of interlocking elements or zipper teeth which are brought into interlocking engagement or fastened by movement of a slider in one direction along the rows and disengaged or unfastened by movement of the slider in the opposite direction.

The present invention addresses the problem of reducing the difficulty involved with the initial engagement of the ends of a separable zipper on a jacket or similar garment, but it will be appreciated that the solution provided by the present invention has useful application to the entire field of slide fasteners without limitation to garments, which will be discussed by way of example herein.

The task of initiating the operation of a conventional separable zipper requires a certain degree of care and dexterity so that many children find the task to be impossible to perform and even adults sometimes find the task to be awkward, inordinately time consuming and frustrating. Conventional separable zippers for jackets and similar garments are typically arranged for right-handed operation of the slider by the wearer. The zipper teeth are arranged in rows along the edges of flexible supporting sheets, commonly known as tapes or stringers, which are sewn to the left and right front vertical edges of the jacket so that the rows of teeth can be interleaved or brought into interlocking engagement by operation of the slider. A terminal pin is provided at the end of each row of teeth at the bottom of the jacket. In the case of a typical right-handed separable zipper, the slider is installed on the right row of teeth and a socket or U-shaped member is installed on the terminal pin at the end of the right row of teeth. The socket serves both as a stop for the slider and as a means for receiving the terminal pin at the end of the left row of teeth. Once the left terminal pin is properly inserted in the socket, the rows of teeth will be aligned and ready to be brought into interlocking engagement in the conventional manner by the forward movement of the slider up the rows of teeth.

The task of initiating operation of the conventional right-handed separable zipper proceeds by inserting the left terminal pin through the left port of the slider down into the socket and then pulling the slider forward up the rows of teeth while holding the left terminal pin firmly in the socket by grasping the adjacent stringer or fabric. If the left terminal pin is not initially inserted fully into the socket, the slider will likely refuse to move forward because the teeth adjacent to the terminal pins will not be properly aligned. On the other hand, if the left terminal pin is initially inserted fully into the socket but is not held firmly in the socket, the forward movement of the slider will likely pull the left terminal pin free from the socket, thus preventing the fastening of the zipper.

The foregoing problems have been addressed in certain respects by the prior art. For example, in place of the conventional terminal pins and socket, U.S. Pat. No. 2,203,005 employs separable end-connecting members which enable proper alignment of the interlocking elements or teeth for engagement by the slider and which, once properly fastened, will not pull free from each other because of the forward movement of the slider. However, the approach of U.S. Pat. No. 2,203,005 has not been adopted to any significant extent apparently because initial engagement of the specialized end-connecting members is no less difficult, if at all, in comparison with the conventional terminal pins and socket. In order to interconnect such end-connecting members, substantial care and dexterity are required to align and engage parts that are as small or smaller than a conventional terminal pin and its associated slider port and socket terminal. Furthermore, the interengagement of such specialized end-connecting members can not be achieved while the adjoining ends of the zipper elements are substantially parallel. Rather, it is necessary that the end-connecting members first be positioned at a wide angle during insertion of a relatively small pivot pin of one end-connecting member into a slot or opening of the other end-connecting member, whereupon only then can the end-connecting members be rotated to bring the adjoining ends of the zipper elements into parallel alignment for passage through the front ports of the slider.

The foregoing problems are solved in accrodance with the present invention as claimed by providing at the ends of the rows of zipper teeth terminals which operate in a manner similar to that of conventional snap fasteners that have cooperating annular snaps which are mated by merely bringing them together in the direction perpendicular to the plane of the adjoining fabric and then pressing them into engagement between thumb and forefinger. As with such snap terminals, the terminals of the present invention can be effortlessly fastened or engaged with a minimum of attention to alignment of the terminals during fastening since they naturally tend to self-align by virtue of their juxtaposition at corresponding positions on the opposed garment edges. Once a portion of one terminal is inserted into or nested within cooperationg portions of the other terminal, the ends of the rows of teeth will then be or will readily become aligned for interengagement by the slider as it is pulled forward. The cooperating or nesting portions of the terminals are relatively large, preferably at least several times larger than the size of one of the front ports of the slider, such that relatively little dexterity is required to bring the terminals into operative engagement. There is no need to feed or pass anything through the slider in order to operatively engage the terminals and align the rearmost ends of the zipper rows in front of their corresponding slider ports. In addition, there is no tendency for the terminals of the present invention to separate in response to the mere forward movement of the slider during initial engagement of the rearmost ends of the rows of zipper teeth as is the case with the conventional pin-and-socket type zipper end connectors.

It will therefore be appreciated that the principal advantage of the invention over prior-art separable zippers is the substantial simplification in the act of engaging the ends or terminal portions of the zipper.

The terminals of the present invention are sufficiently large and easy to operate such that even children who are incapable of fastening a conventional pin-and-socket separable zipper can bring the terminals of the present invention into engagement properly with little attention to alignment and can pull the slider forward up the rows of zipper teeth without the risk that the terminals will pull free of each other.

The presently preferred way of carrying out the invention is described in detail below with reference to drawings which illustrate five specific embodiments, in which.

Figure 1:
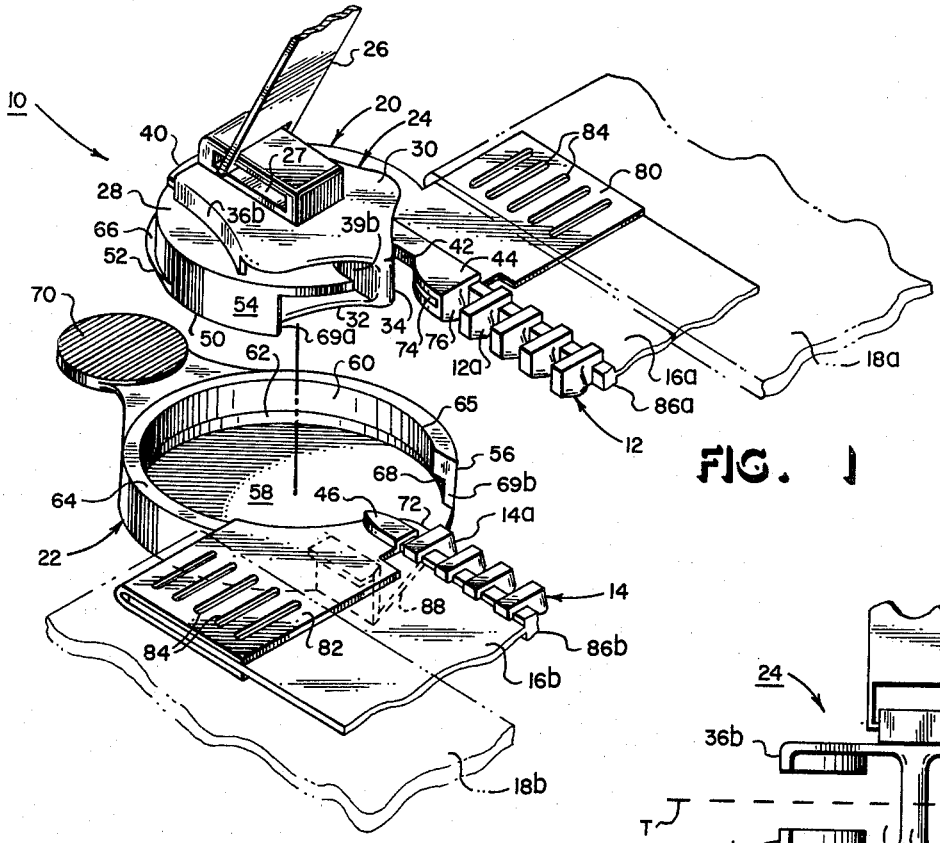
FIG. 1 is perspective view of a first embodiment of the present invention showing first and second zipper terminals aligned just prior to engagement, the first terminal or slider base terminal carrying a slider adapted to interengage conventional rows of zipper teeth, the second terminal or receiving terminal being adapted to mate with the first terminal in the indicated manner.

Referring to FIGS. 1–5, a device for connecting the ends of a separable zipper is illustrated and designated generally by reference numeral 10. The zipper includes interlocking elements or teeth arranged in adjacent rows 12 and 14 in the conventional manner along the respective edges of flexible supporting sheets or stringers **16*a* and 16*b*. Installation of the zipper in a suitable garment is achieved in a conventional manner,such as by sewing the stringers 16*a* and 16*b* to the respective right edge 18*a* and left edge 18*b* of a garment shown in phantom in FIGS. 1—3. The terms "left" and "right" are used herein with reference to the point of view of a wearer of the garment. The device 10 comprises a first terminal or slider base terminal 20 and a second terminal or receiving terminal 22, which terminals can be operatively engaged or brought together into working relationship in a manner similar to the operation of a conventional snap fastener such that the slider base terminal 20 is aligned over and then pressed into the receiving terminal 22** in the manner indicated.

As seen in FIG. 1, the slider base terminal 20 is adapted to carry a conventional slider 24 which is manually operable by means of a handle 26 pivotally mounted in a longitudinal slot 27 atop the slider 24. When the terminals 20 and 22 are disenaged, the slider 24 is normally carried on a base or generally disc-shaped platform 28 which, in the present example, forms an upper surface portion of the terminal 20. The slider 24 includes top and bottom plates 30 and 32 held in spaced-apart parallel planes by a center post 34 which forms the leading edge of the slider 24 as it moves forwardly.

Figure 1A:
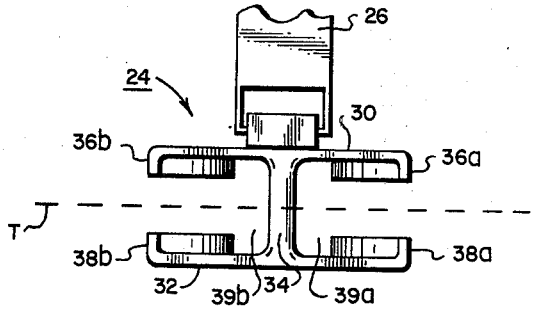
FIG. 1A is a front elevational view of a conventional slider used in the present invention.
Figure 2:
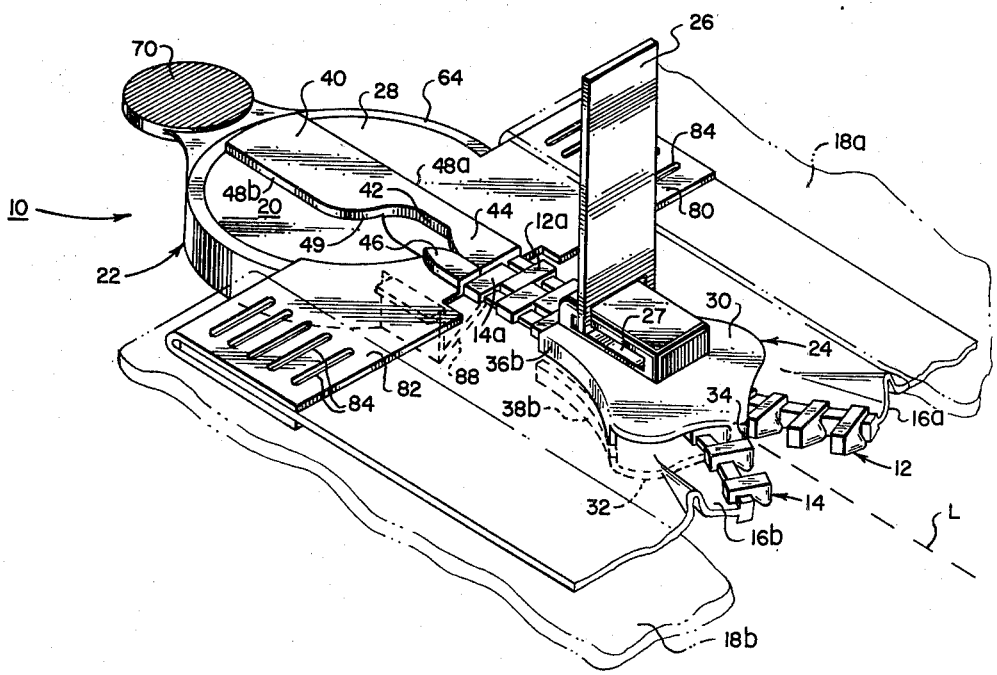
FIG. 2 is a perspective view showing the terminals in operative engagement and the slider moved slightly forward up the rows of zipper teeth.

As seen in FIG. 2, when the slider 24 is moved forwardly, it progressively forces the teeth in the opposed rows 12 and 14 into interlocking engagement. As seen in FIG. 1A, the top slider plate 30 has downwardly extending right and left side rims **36*a* and 36*b* and the bottom slider plate 32 has upwardly extending right and left side rims 38*a* and 38*b*. The rims 36*a* and 38*a* form a right side slot through which the stringer 16*a* passes and the rims 36*b* and 38*b* form a left side slot through which the stringer 16*b* passes, as is conventional in the zipper art. As the slider 24 moves forward, the teeth in the opposed rows 12 and 14 enter respective right and left slider ports 38*a* and 39*b* formed between the front edges of the respective side rims and the center post 34. The manner in which the slider 24 engages and disengages the teeth in the opposed rows 12 and 14 is generally known and thus will not be elaborated on further. From the foregoing, however, it will be appreciated that the slider 24 can be readily moved from the position seen in FIG. 2 to its rearmost position on the slider base terminal 20 because the platform 28 is made to lie in the same plane as the adjacent portions of the stringers 16*a* and 16*b* whenever the terminals 20 and 22 are operatively engaged. Since the stringers 16*a* and 16*b* are ordinarily flexible, the full length of each stringer 16*a* and 16*b* will not necessarily lie in a single plane. However, portions of the stringers 16*a* and 16*b* will lie in what will be referred to herein as the "slider working plane" when they pass through the slider 24. The term "slider working plane" is intended to mean that plane defined by the intersection of longitudinal and transverse axes of the slider 24, the longitudinal axis lying in the direction of slider movement as indicated by the dashed line L in FIG. 2 and the transverse axis bisecting the slider ports 39*a* and 39*b* as indicated by the dashed line T in FIG. 1A**.

The slider base terminal 20 includes a raised shelf 40 which serves as a guide track for slidably cooperating with the upper rims 36*a* and 36*b* so as to keep the slider 24 in general forward alignment when situated in its rearmost position thereon. The platform 28 further includes a notch 42 for receiving the center post 34 of the slider 24 in the manner shown in FIG. 1. The terminal 20 includes a guide segment 44 which defines the rearmost end of the right row 12 of zipper teeth. The guide segment 44 serves in the manner of a cam to guide the leading edge of the center post 34 into operative proximity with the rearmost zipper tooth 12*a* of the right row 12. Similarly, the terminal 22 includes a guide segment 46 which defines the rearmost end of the left row 14 of zipper teeth. The guide segment 46 serves to guide the leading edge of the center post 34 into operative proximity with the rearmost zipper tooth 14*a* of the left row 14, provided the terminals 20 and 22 are operatively engaged and rotationally oriented relative to each other in the position shown. It is presently preferred that the guide segment 44 and the raised shelf 40 have a common colinear right edge 48*a* for a smooth transition in the movement of the slider 24 exiting from and returning to the terminals 20 and 22. The shelf 40 also preferably has a straight left edge 48*b* at its rearmost position and a generally S-shaped curved edge 49 leading from the edge 48*b* to the left edge of guide segment 44. The curved edge 49 permits a slight lateral or rotational movement of the slider 24 with respect to terminal 20 as the center post 34 of the slider 24 is guided between the guide segments 44 and 46 which tends to cause the terminals 20 and 22 to rotate slightly relative to each other.

In accordance with a unique feature of the invention, the terminals 20 and 22 are engaged or nested in a manner similar to that of a snap fastener by pressing the terminals 20 and 22 together after first aligning them in the manner indicated in FIG. 1 while the slider 24 is carried in its rearmost position on the platform 28. The nesting or mating portions of the terminals 20 and 22 are preferably generally annular in shape so that the terminals 20 and 22 can be brought together without having to first align the two zipper rows 12 and 14 at any particular angle to each other as will be appreciated more fully from the description that follows.

Referring again to FIG. 1, the slider base terminal 20 includes curved wall 50 extending downward from the periphery of the platform 28. The wall 50 preferably includes a cuff 52 projecting radially outward from a cylindrical surface 54 of the wall 50. In this embodiment, the cuff 52 is provided only through a semicircular arc around the rearward half of the cylindrical surface 54. The receiving terminal 22 includes a curved mating wall 56 extending upward from the periphery of a generally circular floor 58. The wall 56 preferably includes an upper interior cylindrical surface 60 of a first diameter and a lower interior cylindrical surface 62 of a second diameter, the second diameter being greater than the first diameter. The wall 56 includes an upper peripheral rim 64 which with the cylindrical surface 60 defines an aperture 65 for receiving the mating wall 50 of terminal 20. The terminals 20 and 22 are brought into operative engagement by first seating the cuff 52 on the upper peripheral rim 64 of the wall 56 and then pressing the terminals 20 and 22 together until the bottom of the wall 50 abuts the floor 58, which is designed to occur when the rearmost portions of the stringers 16*a* and 16*b* have become essentially coplanar with the previously defined slider working plane when the slider 24 is in its rearmost position on terminal 20. Accordingly, the term "operative engagement" and terms of similar import are used herein to mean that the terminals 20 and 22 (and their counterparts in subsequently described embodiments) are mated or nested but not necessarily in any particular relative rotational position to each other nor are they necessarily interlocked. It will be appreciated, therefore, that the generally cylindrical construction of the terminals 20 and 22 permits them to be engaged when the adjacent ends of the zipper rows 12 and 14 are in a nonparallel orientation.

In order to facilitate guiding terminal 20 into the terminal 22, the cuff 52 is generally frustoconical so that it tapers with increasing diameter in moving axially upward along the wall 50 to a maximum diameter at a generally radially oriented shelf 66 which interconnects the conical surface of the cuff 52 with the cylindrical surface 54 of the wall 50. The diameter of the cylindrical surface 54 is slightly smaller than the diameter of the upper interior cylindrical surface 60 of the terminal 22, and the maximum diameter of the cuff 52 is slightly greater than the diameter of the surface 60 such that forcing the terminals 20 and 22 together causes the cuff 52 to compress slightly radially and/or causes the wall 56 to expand radially as the cuff 52 slidably passes within the surface 60. The degree of compression of the cuff 52 relative to the expansion of the wall 56 depends on the properties of the materials employed in fabricating the terminals 20 and 22, a relatively rigid and resilient plastic being a preferred material. When the shelf 66 passes beyond the surface 60, the cuff 52 and wall 56 resiliently return to their normal dimensions with the shelf 66 abutting an annular shoulder 68 which interconnects the two cylindrical surfaces 60 and 62. Once the slider 24 is moved forward up the rows 12 and 14 of zipper teeth, inadvertent disengagement of the terminals 20 and 22 is then prevented by virtue of the shelf 66 abutting the annular shoulder 68 at the rearward portions of the terminals 20 and 22 combined with the locking action of the rearmost zipper teeth 12*a* and 14*a* tending to keep the forward portions of the terminals 20 and 22 locked in the engaged position shown in FIG. 2. In addition, the guide segments 44 and 46 can optionally be adapted to interlock with each other to further insure against inadvertent disengagement of the terminals 20 and 22, as will be described below with reference to FIGS. 3 and 4. However, disengagement of the terminals 20 and 22 can readily be achieved when the slider 24 is situated in its rearmost position by pulling upward (in the view of FIG. 1) on the portion of the garment hem or edge 18*a* adjacent to the slider base terminal 20 and simultaneously downward on the portion of the garment hem or edge 18*b* adjacent to the receiving terminal 22, which causes the forward portions of the terminals 20 and 22 to begin to separate since no locking action is then being provided by the unfastened zipper teeth. Such pulling action on the garment edges 18*a* and 18*b* causes the terminals 20 and 22 continue to tilt out of axial alignment until the cuff 52 can slip past the shoulder 68 permitting the terminals 20 and 22 to pull free from each other.

It will be appreciated from the foregoing that the terminals 20 and 22, once engaged, are kept essentially in coaxial alignment by the relatively snug fit of the slidably abutting walls 50 and 56. In accordance with an important feature of the device 10, the mating walls 50 and 56 define circular arcs subtending angles in excess of 180 degrees so that, once engaged, the only relative movement of the terminals 20 and 22 that can occur will be rotational and not translational. Thus, pulling the slider 24 forward away from the terminals 20 and 22 to fasten the zipper rows 12 and 14 will not cause terminal 20 to move forward relative to terminal 22 because the forward portions of surface 54 will abut the cooperating portions of surface 60. However, it is also a desirable feature of the device 10 that, while being carried in its rearmost position on the terminal 20 with the terminals 20 and 22 operatively engaged, the slider 24 is carried within the nesting portions of the terminals 20 and 22. Accordingly, the preferred mating walls 50 and 56 are not continuous through a full 360 degrees, but are provided with gaps 69*a* and 69*b* at their forward portions to permit the slider 24 to exit from the nesting portions of the terminals 20 and 22 as it moves forward to engage the zipper rows 12 and 14. One advantage of this preferred arrangement is that, while the slider 24 is carried in its rearmost position on the terminal 20, the axis of relative rotational movement of the terminals 20 and 22 passes approximately through the center of the slider 24 which is snugly encompassed within the cylinders defined by walls 50 and 56. Thus, if the zipper rows 12 and 14 are not aligned in parallel when it is desired to fasten them together, pulling forwardly on the handle 26 and rearwardly on the receiving terminal 22 will automatically cause the terminals 20 and 22 to rotate until the rows 12 and 14 are substantially parallel, whereupon the slider 24 is permitted to exit forwardly through the aligned gaps 69*a* and 69*b* in the walls 50 and 56. Most preferably, the gaps 69*a* and 69*b* in the forward portions of the walls 50 and 56 are just slightly wider than the maximum width of the slider 24 so that it will not exit through the gaps 69*a* and 69*b* until they are perfectly aligned, thus assuring that the guide segments 44 and 46 will pass through the two front ports 39*a* and 39*b* of the sider 24 on opposite sides of the center post 34. If the terminals 20 and 22 are initially brought together with the rearmost ends of the zipper rows 12 and 14 well out of parallel, at right angles for example, then the leading edge of the center post 34, as the user pulls forwardly on the slider handle 26, will slidably bear against the cylindrical surface 60 as the terminals 20 and 22 begin to rotate into alignment. It will be appreciated that the foregoing preferred features of the device 10 permit the terminals 20 and 22 to be snapped into engagement even when the wearer is in a sitting position during which the zipper rows 12 and 14 are ordinarily misaligned.

Figure 3:
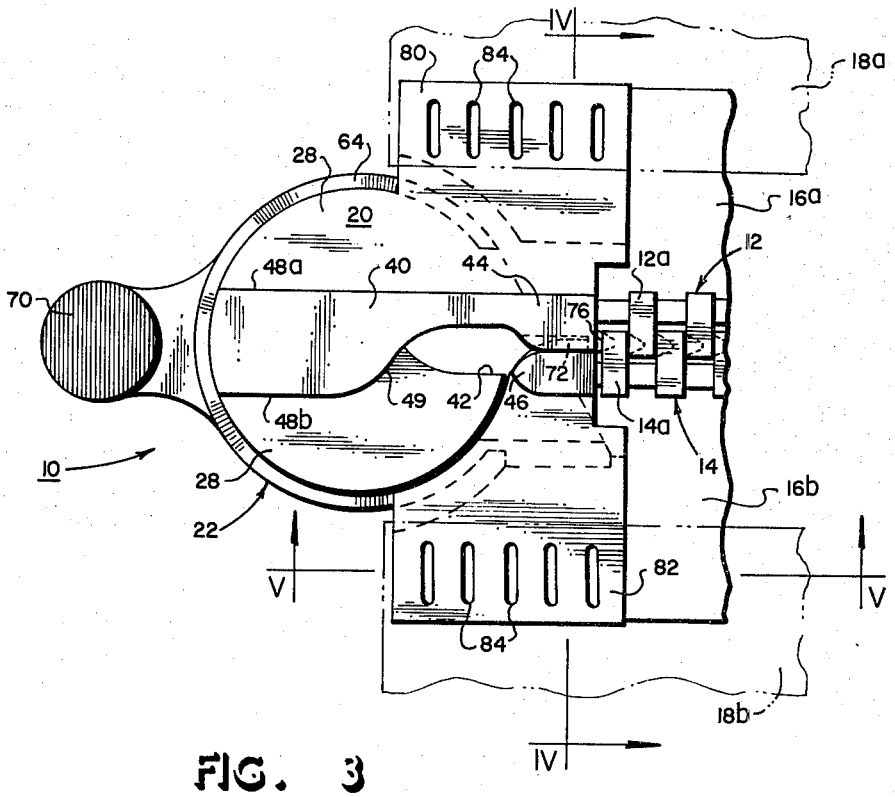
FIG. 3 is a plan view of the terminals with the rearmost zipper teeth in interlocking engagement.

In order to facilitate pulling rearwardly on the terminal 22, a tab 70 is provided at the rear thereof for grasping, for example, between the thumb and index finger of the left hand of the wearer. The provision of the slot 27 atop the slider 24 is believed to facilitate the rotational action of the terminals 20 and 22 by permitting the point of pivotal attachment of the handle 26 to the slider 24 to move forward of the axis of rotation. As the slider 24 begins to move forwardly, the center post 34 slidably engages the facing surfaces of the guide segments 44 and 46 which in turn pass through the slider 24 and are brought into engagement as seen in FIGS. 2 and 3 because the interior passageway of the slider 24 narrows progressively. As the slider 24 continues forwardly, the zipper teeth in the rows 12 and 14 are progressively brought into interlocking engagement in the conventional manner.

Figure 4:
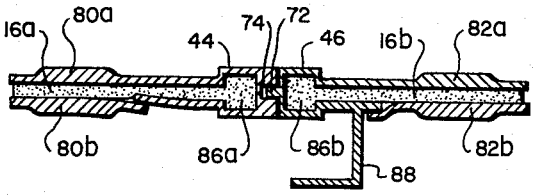
FIG. 4 is a view in cross-section taken along line IV—IV of FIG. 3 in the direction indicated.

Referring now to FIGS. 3 and 4 in conjunction with FIG. 2, additional features of the preferred zipper terminal device 10 will be described. After the slider 24 has been pulled forward up the zipper rows 12 and 14, the terminals 20 and 22 will remain locked in engagement by virtue of the insertion of a tongue 72 on guide segment 46 into a cooperating groove 74 in guide segment 44. The mating of the tongue 72 and groove 74 occurs automatically with a final slight rotation of the terminals 20 and 22 as the rearmost interior surface of the left upper rim 36*b* of the slider 24 pushes counterclockwise on the guide segment 46 while the rearmost interior surface of the right upper rim 36*a* pushes clockwise on the guide segment 44. As previously mentioned, even without the tongue-and-groove locking feature of the guide segments 44 and 46, the interlocked rearmost zipper teeth 12*a* and 14*a* will tend to keep the forward portions of the terminals 20 and 22 in engagement while the cuff 52 (FIG. 1) of terminal 20 abuts the annular shoulder 68 of terminal 22 to keep the rearward portions of the terminals 20 and 22 locked in engagement.

To further assist in securing the terminals 20 and 22, the guide segment 44 preferably interlocks with the zipper tooth 14*a* in like manner as the various other zipper teeth of the opposed rows 12 and 14 interlock with each other. In particular, the guide segment 44 includes a forwardly extending projection 76 evident in FIG. 1, which is adapted to engage a mating indentation in the rearward portion of the zipper tooth 14*a* in the manner depicted in FIG. 3.

Figure 5:
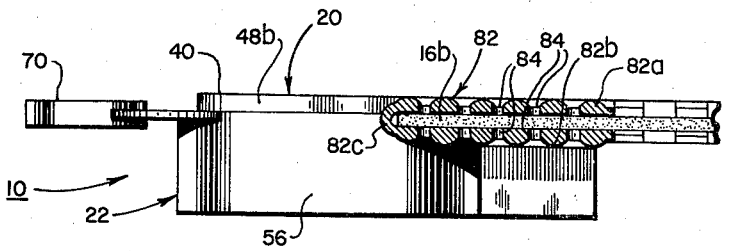
FIG. 5 is a view in cross-section taken along line V—V of FIG. 3 in the direction indicated.

With particular reference to FIGS. 3–5, a preferred technique will now be described for securing the terminals 20 and 22 to the stringers 16*a* and 16*b* and the adjacent garment edges 18*a* and 18*b*. Extending radially outward from the upper forward portions of the terminals 20 and 22 are wings 80 and 82, respectively. The wings 80 and 82 each include top (80*a*, 82*a*) and bottom (80*b*, 82*b*) layers of a folded flange. As exemplified in FIG. 5, the wing 82 has a top layer 82*a* and a bottom layer 82*b* joined at a bend or fold 82*c*. Disposed between the layers 82*a* and 82*b* is the rearmost corner of the stringer 16*b*. Although other means of attachment are also feasible, it is presently preferred for sake of simplicity that the respective wings 80 and 82 be glued to their respective stringers 16*a* and 16*b* and that the wing-stringer assemblies then be securred to their respective adjacent garment edges 18*a* and 18*b* (shown in phantom in FIG. 3) by sewing. Accordingly, slotted openings 84 are provided in the wings 80 and 82, which openings register in the respective top and bottom layers of the wings 80 and 82 to permit a needle and thread (not shown) to pass therethrough. As exemplified in FIG. 5, the exterior faces of the wings 80 and 82 may be curved between openings 84 to facilitate guiding the point of the needle into any of the openings 84, since they are most likely obscured from view by the garment edge 18*a* or 18*b* to be attached thereat.

Referring briefly again to FIG. 4, it will be seen that the stringers 16*a* and 16*b* are provided with beaded edges 86*a* and 86*b*, respectively, in accordance with one of several well-known prior-art techniques for securing the individual zipper teeth to the stringers 16*a* and 16*b*. (It will, of course, be appreciated that the invention can be practiced using other suitable slide-fastening interlocking elements and associated means for attachment to the edges of a garment.) The guide segments 44 and 46 include hollow interiors for accepting the rearmost portions of the beaded edges 86*a* and 86*b* so that attachment of the wings 80 and 82 to the respective stringers 16*a* and 16*b* will automatically self-align the guide segments 44 and 46 with the respective rows 12 and 14 of zipper teeth.

An additional feature of the inventive device 10 which is apparent from FIGS. 1 and 4 involves the provision of an L-shaped member 88 extending forwardly from the wall 56 and the floor 58 of the terminal 22. The L-shaped member 88 gives added support to the guide segment 46 and adjoining wing 82 to resist flexing at the point of attachment of the wing 82 to the rim 64 of the terminal 22. The placement of the L-shaped member 88 also conveniently permits it to serve as a guide chute for the slider 24, as will be appreciated from the view of FIG. 2.

A second embodiment of the invention will now be described with reference to FIGS. 6–8, wherein a zipper terminal device is illustrated and designated generally by reference numeral 110. In order to simplify the description of the device 110, parts that function in a similar manner to corresponding parts in the above-described device 10 are designated using similar reference numerals. The following description will focus only on the most important differences of the device 110 with respect to the above-described device 10. It will be appreciated that, while they are not shown in the similar view of FIG. 6, the rows 12 and 14 of zipper teeth of FIG. 1 would be provided in essentially the same manner along the beaded edges 186*a* and 186*b* of the respective stringers 116*a* and 116*b*.

Figure 7:
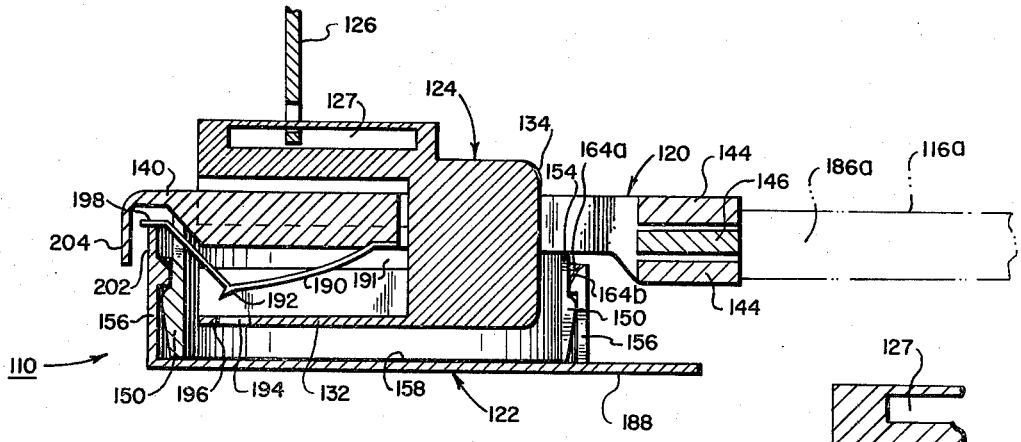
FIG. 7 is a view in cross-section as the terminals of FIG. 6 would appear when operatively engaged with the slider in its rearmost position on the slider base terminal, the view looking in the direction indicated from line VII—VII of FIG. 6.

The most significant difference between the device 110 and the above-described device 10 is the inclusion of a slider retaining mechanism comprising a spring member 190 suspended from the slider base terminal 120 so that it will lie within the interior passageway 191 of the slider 124 and retain the slider 124 in its rearmost position on the terminal 120 unless the terminals 120 and 122 are operatively engaged in the position shown in FIG. 7. The spring member 190 includes a catch 192, which extends into an opening 194 in the bottom plate 132 of the slider 124 when the spring member 190 is unflexed as shown in phantom in FIG. 8, whereby the forward movement of the slider 124 is prevented by virtue of the catch 192 contacting a wall 196 of the bottom plate 132. The spring member 190 includes an arm 198 extending through an opening 200 in a rearward portion of the wall 150 of terminal 120. When the terminals 120 and 122 are operatively engaged, the slider 124 is released for forward movement by a projection 202 extending upward from a rearward portion of the wall 156 of terminal 122 to flex the spring member 190. The terminal 120 preferably includes a lip 204 which extends downward from the rear of the shelf 140 in order to cover the arm 198 to prevent accidental release of the slider 124. The lip 204 and the adjacent portion of terminal wall 150 form a narrow gap into which the projection 202 extends when the terminals 120 and 122 are operatively engaged, thereby pushing the arm 198 upward to flex the spring member 190 thus lifting the catch 192 out of the opening 194.

Figure 6:
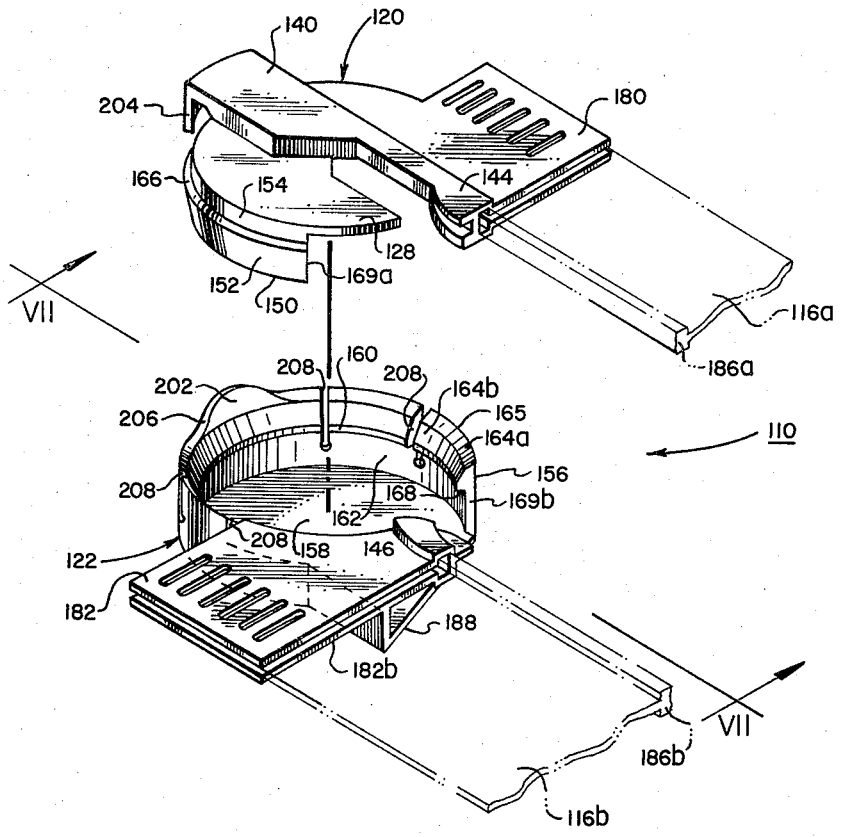
FIG. 6 is a perspective view of a second embodiment of the present invention showing a slider base terminal and a receiving terminal aligned just prior to engagement, the view being similar to FIG. 1 but with the slider removed in order to illustrate various details of the slider base terminal.

As seen best in FIG. 6, the upper peripheral rim of the wall 156 includes two beveled surfaces 164*a* and 164*b* which serve to guide the slider base terminal 120 down into operative engagement with the receiving terminal 122. The spring flexing projection 202 extends upward from the upper beveled surface 164*a* to provide a curved cam surface 206 which is slidably engaged by the spring arm 198 to gradually flex the spring member 190 as the terminals 120 and 122 are rotated to bring the guide segments 144 and 146 into operative proximity. Thus, the slider 124 will not be released for forward movement until the guide segments 144 and 146 are aligned for passage through the front ports of the slider 124 on opposite sides of the center post 134. As the slider base terminal 120 is rotated clockwise with respect to the receiving terminal 122, the arm 198 rides up along cam surface 206 to the top of the projection 202 thereby lifting the catch 192 out of the opening 194, as depicted in FIG. 7.

It is clearly evident from the foregoing description of the device 110 that one important advantage of such a slider retaining mechanism is that the slider 124 will not be released to exit forwardly though the gaps 169*a* and 169*b* in the walls 150 and 156 until the relative rotational position of the terminals 120 and 122 is appropriate for fastening the zipper. Another important advantage of such a slider retaining mechanism is that the slider 124 and slider base terminal 120 can be controlled together as a unit using the slider's handle 126, which is conveniently pivotable and longitudinally moveable within the slot 127. Thus, for example, when the terminals 120 and 122 are separated and the slider 124 is captured on the terminal 120 by virtue of the spring catch 192 extending down into the opening 194, engagement of the terminals 120 and 122 is easily achieved by grasping the handle 126 with one hand and the wing 182 of terminal 122 with the other hand and then merely forcing the terminals 120 and 122 together.

Figure 8:
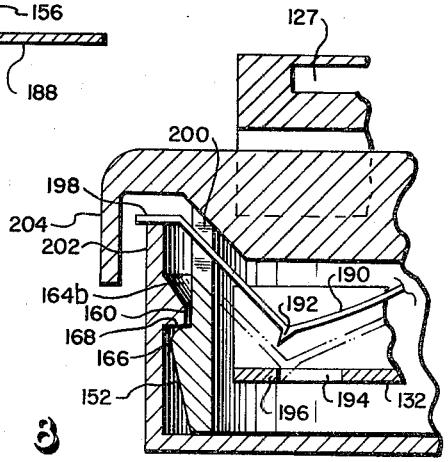
FIG. 8 is an enlarged view of a portion of FIG. 7.

When compared to the device 10 of FIGS. 1–5, the operation of the device 110 of FIGS. 6–8 more nearly approximates the workings of a conventional snap fastener as will be appreciated from the following description of additional features of the device 110. It will be seen from FIG. 6 that the cuff 152 is coextensive with the entire periphery of the wall 150, which is disposed through an arc substantially in excess of 180 degrees. During engagement of the terminals 120 and 122, the cuff 152 is guided by the beveled edges 164*a* and 164*b* through the receiving aperture 165 and down past the innermost surface 160 of terminal compressing the cuff 152 and/or expanding the wall 156 until the outermost edge of the cuff 152 passes beyond the surface 160, whereupon the cuff 152 and the wall 156 resiliently return to their normal dimensions. At this point, terminals 120 and 122 are locked against axial movement but are free to rotate relative to each other. It will of course be appreciated that the distance from the floor 158 to the shoulder 168 will preferably be only slightly greater than the distance from the bottom of the wall 150 to the outermost edge of the cuff 152 so that, as the bottom of the wall 150 snaps into abutment with the floor 158, the terminals 120 and 122 contemporaneously become operatively engaged and interlocked against axial movement without having to rotate the terminals 120 and 122 relative to each other.

The terminals 120 and 122 are readily disengaged by pulling upward on the handle 126 of the slider 124, when situated on the terminal 120, while holding down on terminal 122 with opposing forces sufficiently strong to recompress the cuff 152 and/or reexpand the wall 156 until the cuff 152 can again pass within the surface 160. In order to facilitate this mode of release, the cuff 152 is provided with a curved upper edge 166 for reducing the force required to pull the terminals 120 and 122 apart. In addition, it may be desirable to provide axial slits 208 radially spaced apart around the wall 156 for increased flexibility. Such slits 208 are particularly advantageous where the terminals 120 and 122 are fabricated from a relatively rigid materal, such as steel.

In comparing the two embodiments 10 and 110, it will be appreciated that in both cases the slider base terminal (20 or 120) is snapped into engagement with its receiving terminal (22 or 122), whereas the mode of release employed by device 10 differs somewhat from that employed by device 110. In the case of the device 10, the terminals 20 and 22 are disengaged by tilting them out of coaxial alignment by forcing their forward portions apart until the cuff 52 of terminal 20 can be withdrawn from beneath the shoulder 68 at the rearward portion of terminal 22. In the case of device 110, the terminals 120 and 122 are snapped out of engagement while generally maintaininng the terminals 120 and 122 in coaxial alignment. Such snap-release is achieved by grasping the slider handle 126 or the wing 180 with one hand and the wing 182 with the other hand and pulling in opposite directions. In either case, the disengagement of the respective terminals of devices 10 and 110 requires no special concentration or dexterity. In both cases, the respective terminals readily and automatically release from each other in response to moderate forces tending to pull them apart. However, the snap-release action of the terminals 120 and 122 tends to apply slightly more stress to the wing 182 of device 110 than is applied to the wing 82 of device 10. Accordingly, as seen in FIG. 6, the L-shaped member 188 is preferably permanently secured to the lower wing plate **182*b*** for added support.

In the following description of several additional embodiments of the invention illustrated in FIGS. 9–15, it will be appreciated that the zipper teeth and associated stringers, which are not shown, can be attached to the terminals in the same manner as with the first embodiment of the invention shown in FIGS. 1–5. It will also be appreciated that the wings (380, 382, 480, 482, 580, 582) and guide segments, (344, 346, 444, 446, 544, 546), which are merely shown schematically as solid members in FIGS. 9–15, preferably have provisions for receiving the stringers in a manner similar to that depicted in FIG. 4.

Figure 9:
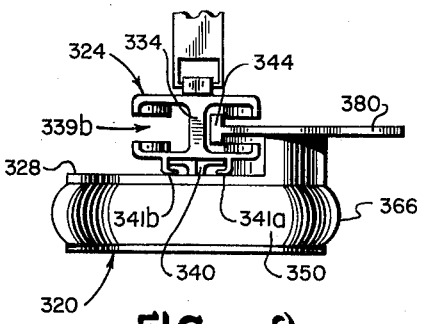
FIG. 9 is a front elevational view of another slider base terminal and associated slider carried thereon.
Figure 10:
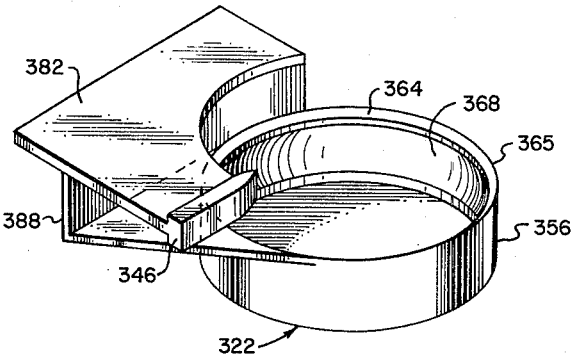
FIG. 10 is a perspective view of the mate to the terminal of FIG. 9, the terminals of FIGS. 9 and 10 representing a third embodiment of the present invention.

A third embodiment of the invention will now be described with reference to FIGS. 9 and 10 wherein parts that function in a similar manner to previously described parts are designated using similar reference numerals. As seen in FIG. 9, the slider 324 is carried above the platform 328 of the slider base terminal 320. This arrangement eliminates the need for a gap in the wall 350 as is required in the first two embodiments of the invention in which the slider is carried partially within the nesting portion of its slider base terminal. Furthermore, the mating wall 356 of the receiving terminal 322 of FIG. 10 is provided through a complete 360° arc or ring. It will therefore be appreciated that when the terminals 320 and 322 of this embodiment are operatively engaged, the slider 324 is carried in its rearmost position above and entirely outside of the nesting portions defined by the annular walls 350 and 356 of the terminals 320 and 322. The structural simplicity of this third embodiment of the invention, though not as compact as the previously described embodiments, makes it comparatively less expensive to fabricate. The slider 324 is held in proper alignment when in its rearmost position on the slider base terminal 320 by means of a guide track 340, which is affixed atop the platform 328, and cooperating L-shaped flanges **341*a* and 341*b*, which extend downward from the bottom of the slider 324. The guide track 340 appears generally T-shaped in the view of FIG. 9 and preferably tapers to a pointed forward end in the manner of guide track 440 to be described below in conjunction with FIG. 11**.

The terminals 320 and 322 are adapted to be snapped into engagement by merely pressing the slider base terminal 320 down through the receiving aperture 365 and into the terminal 322. The wall 350 of terminal 320 has an outwardly curved peripheral surface 366 which abuts a cooperating recess or indented surface 368 along the interior of the wall 356 of terminal 322. The interior dimension of the upper bevelled rim 364 of terminal 322 and the cooperating portions of the wall 350 of terminal 320 are adapted so that the wall 350 will contract slightly and/or the wall 356 will expand slightly so as to allow the engagement of the terminals 320 and 322. When engaged, however, the terminals 320 and 322 are essentially free to rotate relative to each other so that the guide segment 346 can be positioned to pass into the left front slider port **339*b* just to the left of the center post 334. The guide segment 346 is supported over and just forward from the rim 364 by means of the wing 382 which in turn cantilevers from its L-shaped supporting wall 388**.

Figure 11:
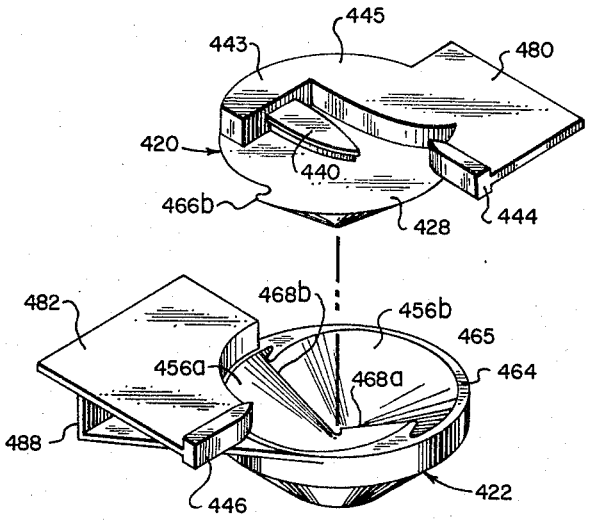
FIG. 11 is a perspective view of a fourth embodiment of the present invention illustrating the top front surfaces of a slider base terminal and associated receiving terminal aligned just prior to engagement.
Figure 12:
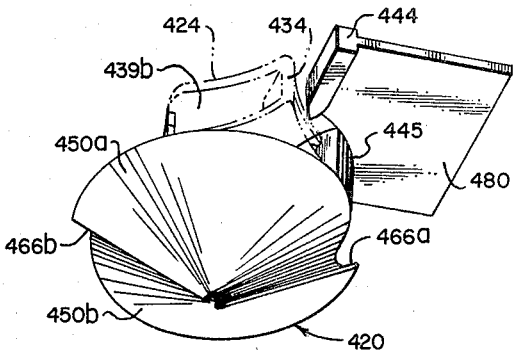
FIG. 12 is a perspective view of the bottom surface of the slider base terminal of FIG. 11 separate from its receiving terminal with the addition of a slider shown in phantom lines as it would appear when carried in its rearmost position thereon.
Figure 13:
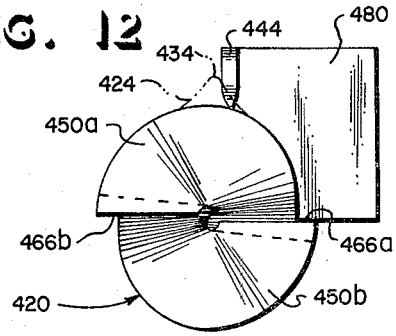
FIG. 13 is a plan view of the bottom surface of the slider base terminal of FIG. 12.

A fourth embodiment of the invention will now be described with reference to FIGS. 11–13 wherein parts that function in a similar manner to previously described parts are designated using similar reference numerals. It will be appreciated that the slider 424 (partially visible in phantom in FIGS. 12 and 13) is held in proper orientation of the slider base terminal 420 by means of a guide track 440 (seen in FIG. 11) which cooperates with flanges (not shown) on the bottom of the slider 424 in a similar manner to the guide track 340 and flanges **341*a* and 341*b* of the previously described embodiment as illustrated in FIG. 9. To the rear of the guide track 440 is a rim 443 which serves as a stop for the slider 424. Like the previous embodiment of FIGS. 9 and 10, the slider 424 is supported in its rearmost position on a platform 428 above and entirely outside of the nesting portions of the terminals 420 and 422, as will be apparent from FIGS. 11 and 12. The wings 480 and 482 and guide segments 444 and 446 are therefore supported above the plane of the platform 428, the wing 480 cantilevering from a supporting shelf 445 and the wing 482 cantilevering from an L-shaped supporting wall 488**.

The slider base terminal 420 includes spiral-shaped bottom walls or surfaces **450*a* and 450*b* which are adapted to slidably abut complementary walls or surfaces 456*a* and 456*b* of the receiving terminal 422 during engagement of the terminals 420 and 422. By bringing the surfaces 450*a* and 450*b* into contact with the respective surfaces 456*a* and 456*b* and rotating the terminals 420 and 422 relative to each other until the guide segment 446 is aligned for passage through the left front port 439*b* of the slider 424, locking or latching members 466*a* and 466*b* on the bottom of the terminal 420 become partially engaged with complementary members 468*b* and 468*b* down within the aperture 465 of terminal 422. Thereafter, as the slider 424 is moved forwardly beyond the guide segments 444 and 446, a final slight rotation of the terminals 420 and 422 causes the latching members 466*a* and 466*b* of terminal 420 to become completely engaged with the respective latching members 468*a* and 468*b* of terminal 422. Preferably, when the slider 424 is in its rearmost position, it extends forward slightly beyond the front edge of surface 450*a* so that the right side of the center post 434 abuts the adjacent edge of the guide segment 444 as depicted in FIG. 13. Thus, when the terminal 420 is rotated fully clockwise with respect to terminal 422, the left side of the center post 434 will abut the guide segment 446, thereby assuring that the zipper rows are perfectly aligned in front of their respective slider ports prior to moving the slider 424** forward.

It will be appreciated that the generally cone-like arrangement of the terminals 420 and 422 greatly facilitates guiding them into operative engagment. The receiving aperture 456 defined by the upper peripheral rim 464 of terminal 422 provides an easy target for the bottom portion of terminal 420. Furthermore, the dual-spiral construction of the cooperating surfaces of the terminals 420 and 422 tends to promote rotation in the proper direction for interlocking the terminals 420 and 422 merely by the force of pressing the terminals 420 and 422 together.

Figure 14:
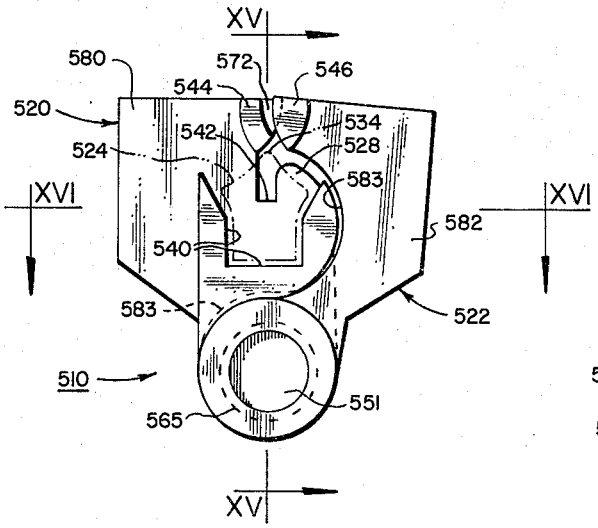
FIG. 14 is a top plan view of a fifth embodiment of the present invention illustrating a slider base terminal and a receiving terminal in operative engagement.
Figure 15:
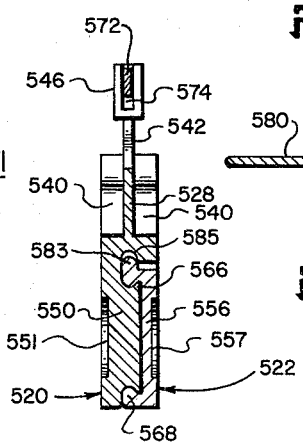
FIG. 15 is a view in cross-section taken along line XV—XV of FIG. 14 in the direction indicated.
Figure 16:
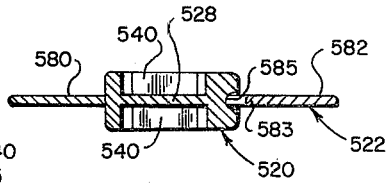
FIG. 16 is a view in cross-section taken along line XVI—XVI of FIG. 14 in the direction indicated.

A zipper terminal device 510 in accordance with a fifth embodiment of the invention will now be described with reference to FIGS. 14–16 wherein parts that function in a similar manner to previously described parts are designated using similar reference numerals. The slider employed in this embodiment is illustrated by the phantom outline 524 in FIG. 14. When in its rearmost position as shown, the slider 524 is carried forward and entirely outside of the nesting portions of the terminal 520 and 522. For this purpose, the slider base terminal 520 is provided with guiding and retaining walls 540 which provide a slider receptacle on both sides of a central web 528. The web 528 is inserted between the plates of the slider 524 in a manner similar to the way in which the platform 28 is inserted between the plates 30 and 32 of the slider 24 of FIG. 1. When in its rearmost position, the slider 524 is held in proper alignment by the walls 540 with the center post 534 of the slider 524 resting in a notch 542 in the web 528. As seen in FIG. 15, the slider base terminal 520 includes a raised annular portion 550 adapted to mate with an annular recessed portion 556 of the receiving terminal 522. The nesting or mating portions of the terminals 520 and 522 include peripheral rims 566 and 568, respectively, which operate in the manner of a snap fastener to hold the terminals 520 and 522 in operative engagement while permitting relative rotational movement thereof.

The operation of the device 510 proceeds as follows. With the slider 524 in its rearmost position on the terminal 520 as depicted in FIG. 14, the terminals 520 and 522 are pressed or snapped into operative engagement as seen best in the view of FIG. 15. The exterior faces of the terminals 520 and 522 are provided with shallow recesses 551 and 557 to facilitate grasping the respective annular nesting portions 550 and 556 between the thumb and index finger of the user while snapping the terminals 520 and 522 into engagement. Once engaged, the terminal 522 is rotated slightly counterclockwise with respect to the terminal 520 to the approximate position seen in FIG. 14 wherein the guide segment 546 has become aligned for passage through the respective front port of the slider 524. This relative rotation will tend to occur automatically as the user pulls downward on the terminals 520 and 522 provided they are not grasped too tightly. Thereafter, the slider 524 can be pulled up the rows of zipper teeth (not shown). As the slider 524 passes the guide segments 544 and 546, they are first forced apart slightly by the center post 534 and then brought back tightly together as the passageway within the slider 524 narrows. The guide segment 544 preferably includes a tongue portion 572 which fits into a cooperating groove 574 in the guide segment 546 as seen best in FIG. 15, thereby interlocking the front portions of the terminals 520 and 522 when the zipper teeth (not shown) are fastened. To further assist in interlocking the terminals 520 and 522 as will be appreciated best from the view of FIG. 16, an inner edge 583 of the wing 582 can be nested within a cooperating groove 585 in the adjacent edge of the terminal 520. In FIG. 16, the edge 583 is shown in the position just prior to its entering the groove 585. In addition, the edge 583 can be extended down around the upper periphery of the adjoining annular nesting portion 556 to interlock with a cooperating portion of the groove 585 as seen best in FIG. 15.

In accordance with an important feature of the present invention, the nesting portions 550 and 556 are relatively large compared to the conventional terminal pin (not shown) which would be used with the slider 524 in a conventional pin-and-socket separable zipper. In FIG. 14, the pertinent parts of which are generally accurately scaled, the diameter of the receiving aperture 565 (shown in dotted outline) of the nesting portion 556 is approximately equal to the width of the slider 524. It will be appreciated, therefore, that the area of the receiving aperture 565 is at least twice as large as the area of one of the slider ports. Accordingly, aligning and engaging the nesting portions 550 and 556 of the terminals 520 and 522 is significantly easier than the act of feeding a terminal pin (not shown) into the respective front slider port in a comparably sized prior-art separable zipper.

It will be appreciated that the size differences are even more advantageous when comparing the previously described four embodiments to the prior art. For example, it will be appreciated that the receiving aperture 65 of the device 10 of FIG. 1 has a diameter at least as large as the overall length of the slider 24. Thus, it should be readily apparent that the area of the receiving aperture 65 of the device 10 is very much greater than the area of one of the slider ports, such as the left slider port **39*b***.

Therefore, each of the above-described embodiments of the invention greatly reduces the care and dexterity required in connecting the ends of a separable zipper. Rather than having to first feed a relatively small terminal pin through one port of a slider as is done with conventional pin-and-socket type separable zippers, relatively large and substantially self-aligning terminals are first fastened and then, if need be, rotated until the rows of zipper teeth are properly aligned for interfastening by the slider.

Those skilled in the art will appreciate that the presently illustrated five embodiments are merely exemplary of the great variety of alternate embodiments contemplated by the present invention. For example, the present invention can be practiced using a terminal arrangement wherein the nesting portions are disposed to one side of the slider when in its rearmost position so that the axis of rotation of the terminals does not intersect the line along which the slider moves, as is the case with each of the presently illustrated embodiments. Furthermore, other terminal devices are contemplated wherein the slider is carried in its rearmost position on the terminal having the female rather than the male structure of the nesting portions, so that the term "receiving terminal" as used herein is not intended to be limited to terminals having the female structure. Other modifications and alternatives are within the spirit and scope of the present invention as defined by the appended claims.

What is claimed is:

1. A device for connecting the ends of a separable zipper of the type having the first (12) and second (14) opposed rows of teeth and a slider (24) for engaging and disengaging the rows of teeth, each row of teeth being disposed along the edge of a supporting sheet (16*a*, 16*b*), the slider having first (39*a*) and second (39*b*) adjacent ports at the front thereof which lead to a common passageway within the slider, the ports being adapted to receive the respective first and second rows of teeth as the slider is moved forward whereby the teeth in the opposed rows are progressively brought into interlocking engagement within the passageway, the device having first (20) and second (22) terminals disposed at the respective rearward ends of the first and second rows of teeth, the first terminal including means (28) for carrying the slider when the rows of teeth are fully disengaged, one of the terminals having portions (60, 64) defining an aperture (65) for receiving cooperating portions (52,54) of the other terminal such that insertion of the cooperating portions into the receiving aperture couples the terminals in operative engagement, characterized in that the area defined by the receiving aperture (65) is at least twice as large as the area defined by one of the slider ports (39*b*).

2. A device for connecting the ends of a separable zipper of the type having first (12) and second (14) opposed rows of teeth and a slider (24) for engaging and disengaging the rows of teeth, each row of teeth being disposed along the edge of a supporting sheet (16*a*, 16*b*), the slider having first (39*a*) and second (39*b*) adjacent ports at the front thereof which leads to a common passageway within the slider, the slider having facing side rims (36*a*, 38*a*; 36*b*, 38*b*) defining first and second side slots through which the supporting sheets pass, the ports being adapted to receive the respective first and second rows of teeth as the slider is moved forward whereby the teeth in the opposed rows are progressively brought into interlocking engagement within the passageway, the slider having a center post (34) at the front thereof between the ports, the center post being adapted to progressively disengage the rows of teeth as the slider is moved rearwardly along the rows, the slider having two mutually perpendicular main axes, one being a longitudinal axis (L) lying in the direction of slider movement and the other being a transverse axis (T) bisecting the ports, the longitudinal and transverse axes intersecting each other to define a slider working plane, the device having first (20) and second (22) terminals disposed at the respective rearward ends of the first and second rows of teeth, the first terminal including means (28) for carrying the slider when the rows of teeth are fully disengaged, one of the terminals having portions (60, 64) defining an aperture (65) for receiving cooperating portions (52, 54) of the other terminal such that insertion of the cooperating portions into the receiving aperture by relative movement of the terminals in the direction substantially perpendicular to the slider working plane couples the terminals in operative engagement, characterized in that the area defined by the receiving aperture (65) is at least twice as large as the area defined by one of the slider ports (39*b*).

3. The device of claim 1 wherein the receiving aperture is generally annular in shape as defined by a peripheral rim, the receiving aperture having a diameter about as large as the overall length of the slider.

4. The device of claim 1 wherein the receiving aperture is generally annular in shape as defined by a peripheral rim, the receiving aperture having a diameter at least as large as the overall length of the slider.

5. The device of claim 1 wherein the receiving aperture is generally annular in shape as defined by a peripheral rim, the receiving aperture having a diameter approximately equal to the width of the slider.

6. The device of claim 5 wherein the terminals are further characterized in that no part of the second terminal must be passed into either of the side slots of the slider in order to operatively engage the terminals and align the rearmost end of the second row of teeth in front of the second slider port.

7. A device for connecting the ends of a separable zipper of the type having first (12) and second (14) opposed rows of teeth and a slider (24) for engaging and disengaging the rows of teeth, each row of teeth being disposed along the edge of a supporting sheet (16*a*, 16*b*), the slider having first (39*a*) and second (39*b*) adjacent ports at the front thereof which lead to a common passageway within the slider, the ports being adapted to receive the respective first and second rows of teeth as the slider is moved forward whereby the teeth in the opposed rows are progressively brought into interlocking engagement within the passageway, the slider having a center post (34) at the front thereof between the ports, the center post being adapted to progressively disengage the rows of teeth as the slider is moved rearwardly along the rows, the slider having two mutually perpendicular main axes, one being a longitudinal axis (L) lying in the direction of slider movement and the other being a transverse axis (T) bisecting the ports, the longitudinal and transverse axes intersecting each other to define a slider working plane, the device having first (20) and second (22) terminals disposed at the respective rearward ends of the first and second rows of teeth, the first terminal including means (28) for carrying the slider when the rows of teeth are fully disengaged, one of the terminals having portions (60, 64) defining an aperture (65) for receiving cooperating portions (52, 54) of the other terminal such that insertion of the cooperating portions into the receiving aperture by relative movement of the terminals in the direction substantially perpendicular to the slider working plane couples the terminals in operative engagement, characterized in that the terminals (20, 22) are adapted so that they can be brought together into operative engagement to align the rearmost end (46) of the second row of teeth in front of the second slider port (39*b*) solely by relative translational movement of the terminals.

8. The device of claim 7 wherein the terminals (20, 22) are further characterized in that no part of the second terminal (22) must be passed through any portion of the slider (24) in order to operatively engage the terminals and align the rearmost end (46) of the second row of teeth in front of the second slider port (39*b*).

9. The device of claims 2 or 7 further characterized in that the terminals (20, 22) include slidably cooperating surfaces (54, 60) for permitting relative rotational movement of the terminals when the terminals are operatively engaged with the slider (24) in its rearmost position on the first terminal (20), the axis of rotational movement being substantially perpendicular to said slider working plane, the terminals being adapted to permit their operative engagement solely by relative translational movement along the rotational axis while the terminals are rotationally positioned relative to each other within a range of angles including the relative rotational position wherein the rearmost ends (44, 46) of the first and second rows of teeth are aligned in front of the respective first and second slider ports (39*a*, 39*b*).

10. The device of claim 9 further characterized in that the first and second terminals (20, 22) include respective first and second mating walls (50, 56), one such wall (56) defining the receiving aperture (65) and the other such wall (50) defining the cooperating portions (52, 54) that are inserted into the receiving aperture during coupling of the terminals, the mating walls including means (66, 68) for interlocking the terminals against separation when the rows of teeth are fastened.

11. The device of claim 10 further characterized in that the first terminal (20) includes a guide segment (44) at the rearmost end of the first row (12) of teeth and the second terminal (22) includes a guide segment (46) at the rearmost end of the second row (14) of teeth, one such guide segment including a tongue portion (72) and the other such guide segment including a groove portion (74), the groove portion being adapted to receive the tongue portion to interlock the terminals against separation once the slider (24) has moved forwardly beyond the guide segments.

12. The device of claim 10 further characterized by means (50) on the first terminal (20) abutting means (58) on the second terminal (22) to stop the relative translational movement of the terminals during coupling upon reaching a point such that at least the rearmost end (46) of the second row of teeth is brought into the slider working plane, whereby the terminals are then operatively engaged.

13. The device of claim 12 further characterized in that the terminal interlocking means (66, 68) becomes operative as the terminals (20, 22) initially become operatively engaged without having to rotate the terminals relative to each other.

14. The device of claim 10 further characterized in that the terminal interlocking means (466*a*, 466*b*, 468*a*, 468*b*) become operative only after rotating the operatively engaged terminals (420, 422).

15. The device of claim 10 further characterized in that the slider (24) is carried in its rearmost position at least partially within the mating walls (50, 56) wherein the mating walls are provided with gaps (69*a*, 69*b*) at the front thereof for passage of the slider therethrough.

16. The device of claim 15 wherein the gaps are just slightly larger than the maximum width of the slider so that the slider can only pass through the gaps when the gaps are precisely aligned.

17. The device of claim 10 further characterized in that the slider (324) is carried in its rearmost position entirely outside of the mating walls (350, 356) wherein each mating wall is disposed through a full 360°.

18. The device of claim 17 further characterized in that the slider (324) is carried in its rearmost position above the mating walls (350, 356) so that the rotational axis of the terminals (320, 322) passes through the slider.

19. The device of claim 17 further characterized in that the slider (524) is carried in its rearmost position adjacent to the mating walls (550, 556) so that the rotational axis of the terminals does not pass through the slider.

20. The device of claim 19 wherein the first terminal includes a web adapted to pass between the side rims of the slider as the slider is brought into its rearmost position on the first terminal, the first terminal further including walls for forming a slider receptacle around the sides and rearward periphery of the web, the slider receptacle being located forwardly from the respective mating walls of the terminals.

21. The device of claim 20 wherein the web includes a notch for receiving the center post of the slider to maintain the slider in proper forward alignment when in its rearmost position in the slider receptacle.

22. The device of claim 20 wherein the second terminal is provided with a wing plate extending between the second mating wall and the rearmost end of the second row of teeth, and wherein the first terminal is provided with a curved groove adapted to receive a curved edge of the wing plate of the second terminal when the rows of zipper teeth are fastened to assist in interlocking the terminals against separation.

23. The device of claim 10 further characterized by means (190, 192, 194, 196, 198, 200, 202, 204, 206) for retaining the slider (124) on the first terminal (120) when the first and second terminals (120, 122) are disengaged wherein the retaining means is adapted to release the slider for forward movement when the terminals are operatively engaged.

24. The device of claim 23 further characterized in that the retaining means (190, 192, 194, 196, 198, 200, 204, 206) is adapted to release the slider (124) only when the terminals (120, 122) are operatively engaged and rotationally positioned so that the rearmost end (146) of the second row of teeth is aligned in front of the second slider port.

25. The device of claim 23 wherein the retaining means includes a spring member suspended from the first terminal, the spring member including a catch for contacting a wall of the slider when the spring member is unflexed and the slider is in its rearmost position on the first terminal.

26. The device of claim 25 wherein the second terminal includes a projection adapted to flex the spring member only when the terminals are operatively engaged and rotationally positioned so that the rearmost end of the second row of teeth is aligned in front of the second slider port.

27. The device of claim 26 wherein the first terminal includes means for covering the spring member to prevent accidentally flexing the spring member other than by means of the projection on the second terminal.

28. A separable zipper comprising:

first and second rows of teeth, each row of teeth being disposed along the edge of a supporting sheet;

a slider having top and bottom plates and a center post for holding the plates in spaced-apart parallel planes, the plates having facing side rims defining first and second side slots through which the supporting sheets pass, the front edges of the side rims defining first and second ports on opposite sides of the center post, the ports leading to a common passageway within the slider where the teeth are progressively engaged or disengaged depending on the direction of slider movement;

a first terminal disposed at the rearward end of the first row of teeth and adapted to carry the slider when the rows are fully disengaged;

a second terminal disposed at the rearward end of the second row of teeth, the second terminal being engageable with the first terminal to bring at least the rearmost ends of the rows of teeth into a third plane intermediate and parallel to the spaced-apart parallel planes;

the terminals including slidably cooperating surfaces for permitting relative rotational movement thereof thereabout an axis generally perpendicular to the parallel planes when the terminals are operatively engaged with the slider in its rearmost position on the first terminal, the terminals being characterized in that no part of the second terminal must be passed into either of the side slots of the slider in order to operatively engage the terminals and align the rearmost end of the second row of teeth in front of the second slider port.

29. The device of claims 4 or 28 wherein the first and second terminals include respective first and second mating walls, one such wall defining the receiving aperture and the other such wall being insertable into the receiving aperture during coupling of the terminals, the mating walls including means for interlocking the terminals against separation when the rows of teeth are fastened.

30. The device of claim 29 wherein the first terminal includes a guide track for slidably cooperating with at least one of the side rims of the slider to keep the slider in general forward alignment when situated on the first terminal.

31. The device of claim 29 wherein the first terminal includes a generally disc-shaped platform, the platform being adapted to pass at least partially into the side slots of the slider in order to support the slider in its rearmost position on the first terminal.

32. The device of claim 31 wherein the platform lies in the same plane as the supporting sheets whenever the terminals are operatively engaged.

33. The device of claim 32 wherein each terminal includes an outwardly extending wing, the wings being coplanar with the platform when the terminals are operatively engaged, the wings being secured to the respective supporting sheets.

34. The device of claim 33 wherein each wing includes a top and bottom layer sandwiching the respective supporting sheet.

35. The device of claim 34 wherein the bottom layer of the wing of the second terminal is secured to the second terminal by means of an L-shaped member extending forwardly from the mating wall of the second terminal.

36. The device of claim 21 wherein the platform further includes a notch for receiving the center post of the slider when the slider is in the rearmost position on the first terminal.

37. The device of claim 29 wherein the rotational axis of the terminals passes through the slider when the slider is in its rearmost position on the first terminal.

38. The device of claim 29 wherein one of the terminals includes a tab adapted to be grasped by the fingers of the user for pulling rearward on the engaged terminals while simultaneously pulling forward on the slider during fastening of the rows of teeth.

39. The device of claim 38 wherein the tab is disposed at the rear of the second terminal.

40. The device of claim 29 wherein the first terminal includes a guide segment adjoining the rearmost end of the first row of teeth and the second terminal includes a guide segment adjoining the rearmost end of the second row of teeth, the guide segments serving to guide the leading edge of the center post into operative proximity with the rearmost teeth of the respective rows when the terminals are operatively engaged and the rearmost teeth are disposed side by side.

41. The device of claim 40 wherein the terminals are rotatable relative to each other while operatively engaged so that the rows of teeth may be aligned side by side for passage through the ports of the slider.

42. The device of claim 41 wherein the first terminal includes a guide track for slidably cooperating with the slider to keep the slider in general forward alignment when situated in its rearmost position on the first terminal, the guide track including means for permitting a slight relative rotational movement of the slider with respect to the first terminal as the center post of the slider passes between the guide segments while moving forwardly to initiate engagement of the rows of teeth.

43. The device of claim 29 wherein the terminals are generally annular in shape so that they can be brought together into operative engagement without having to align the rows of teeth at any particular angle relative to each other.

44. The device of claim 43 wherein the first terminal includes a first curved wall and the second terminal includes a second curved wall, the curved walls being slidable relative to each other when the terminals are operatively engaged, the curved walls confining the relative rotational movement of the terminals when operatively engaged so as to define the axis of relative rotational movement of the terminals, the first curved wall including a cuff, the second curved wall including a shoulder for frictionally engaging the cuff to resist separation of the terminals when the rows of teeth are fastened, the cuff and shoulder being slidable relative to each other during rotation of the terminals when the rows of teeth are unfastened.

45. The device of claim 44 wherein the curved walls are provided through complete circular arcs of 360 degrees and wherein the slider is carried on the first terminal above the first curved wall.

46. The device of claim 45 wherein the first terminal includes a guide track affixed above the first curved wall and wherein the slider includes flanges at the bottom thereof for slidably cooperating with the guide track to maintain the slider aligned for forward movement relative to the first row of teeth when the slider is in its rearmost position on the first terminal.

47. The device of claim 44 wherein the cuff forms a semicircular arc around the rearward half of the first curved wall.

48. The device of claim 44 wherein the cuff includes a generally frustoconical surface adapted to guide the first terminal into operative engagement with the second terminal.

49. The device of claim 44 wherein the cuff is coextensive with the entire periphery of the first curved wall and wherein the first curved wall is disposed through an arc substantially in excess of 180 degress.

50. The device of claim 44 wherein the second curved wall is provided with a plurality of axial slits at spaced radial positions around the second wall.

51. The device of claim 50 wherein the terminals are fabricated from metal.

* * * * *

UNITED STATES PATENT AND TRADEMARK OFFICE

CERTIFICATE OF CORRECTION

PATENT NO. : 4,232,430

DATED : Nov. 11, 1980

INVENTOR(S) : Martin F. Friedberg

It is certified that error appears in the above-identified patent and that said Letters Patent are hereby corrected as shown below:

Column 15, line 34, "leads" should read -- lead--;
line 65, "1" should read -- 2 --.

Column 16, lines 1 and 5, "1", each occurrence, should read -- 2 --.

Column 18, line 47, after "second" insert -- opposed --.

Column 19, line 46, "21" should read -- 31 --.

Signed and Sealed this

*Twenty-eighth* Day of *April 1981*

[SEAL]

*Attest:*

RENE D. TEGTMEYER

*Attesting Officer*

*Acting Commissioner of Patents and Trademarks*